US009616904B2

(12) United States Patent
Lv et al.

(10) Patent No.: US 9,616,904 B2
(45) Date of Patent: Apr. 11, 2017

(54) TELESCOPIC MECHANISM IN TELESCOPIC HITCH BUFFER DEVICE FOR USE IN HIGH SPEED ELECTRIC MULTIPLE UNITS

(71) Applicant: CRRC QINGDAO SIFANG ROLLING STOCK RESEARCH INSTITUTE CO., LTD., Qingdao (CN)

(72) Inventors: Xiaozhong Lv, Qingdao (CN); Hui Liu, Qingdao (CN); Kai Chen, Qingdao (CN)

(73) Assignee: CRRC QINGDAO SIFANG ROLLING STOCK RESEARCH INSTITUTE CO., LTD., Shandong (CN)

( * ) Notice: Subject to any disclaimer, the term of this patent is extended or adjusted under 35 U.S.C. 154(b) by 289 days.

(21) Appl. No.: 14/470,865

(22) Filed: Aug. 27, 2014

(65) Prior Publication Data

US 2014/0360962 A1 Dec. 11, 2014

Related U.S. Application Data

(63) Continuation of application No. PCT/CN2012/072228, filed on Mar. 13, 2012.

(51) Int. Cl.
*B61G 7/00* (2006.01)
*B61G 7/08* (2006.01)
(Continued)

(52) U.S. Cl.
CPC ..... *B61G 7/00* (2013.01); *B61G 5/00* (2013.01); *B61G 7/08* (2013.01); *B61G 9/20* (2013.01); *B61G 11/18* (2013.01)

(58) Field of Classification Search
CPC ... B61G 5/00; B61G 7/00; B61G 7/08; B61G 9/00; B61G 9/20; B61G 11/00; B61G 11/18
See application file for complete search history.

(56) References Cited

U.S. PATENT DOCUMENTS 3,922,007 A * 11/1975 Friedebach ..... B60D 1/44 280/447
4,077,234 A * 3/1978 Crochet, Sr. ..... B60D 1/28 280/478.1

(Continued)

*Primary Examiner* — Jason C Smith
(74) *Attorney, Agent, or Firm* — J.C. Patents

(57) ABSTRACT

The patent was disclosed a telescopic mechanism in a telescopic hitch buffer device for use in high speed electric multiple unit (EMU) trains. The telescopic mechanism comprises a compression rod (2) located inside a movable housing (1) of said hitch buffer device, one end of said compression rod (2) being connected to the movable housing (1), and a bearing connector (3) encasing the compression rod (2). A guiding barrel (4) is fixedly mounted outside the bearing connector (3). An extension/retraction driving mechanism (9) is provided between the guiding barrel (4) and the movable housing (1). A locking mechanism comprises protrusions (6) distributed at the other end of the compression rod (2), and grooves (7) in engagement with protrusions (6) on the inner wall of the bearing connector (3). One end of the compression rod (2) is connected to the movable housing (1) via a torsion spring (5), keeping the compression rod (2) and the bearing connector (3) in a locked state; an unlocking driving mechanism is provided on the outside of the movable housing (1), and is in an unlocked state when the protrusions (6) face the grooves (7), in which case, the movable housing (1) and the bearing connector (3) can slide relative to each other. Since the extension/retraction driving mechanism (9) is provided inside the movable housing (1), volume is reduced, good protection is provided for respective components, and the telescopic mechanism (Continued)

and the locking mechanism are relatively simple in structure, labor-saving, reliable in operation, and can bear relatively large loads.

12 Claims, 4 Drawing Sheets

(51) Int. Cl.

| | |
|---|---|
| ***B61G 9/20*** | (2006.01) |
| ***B61G 5/00*** | (2006.01) |
| ***B61G 11/18*** | (2006.01) |

(56) References Cited

U.S. PATENT DOCUMENTS

| | | | | | |
|---|---|---|---|---|---|
| 4,773,667 | A * | 9/1988 | Elkins | B60D 1/40 | 280/479.3 |
| 5,188,385 | A * | 2/1993 | Wilson | B60D 1/40 | 280/477 |
| 2004/0201200 | A1* | 10/2004 | Ahlquist | B60D 1/065 | 280/477 |
| 2006/0273549 | A1* | 12/2006 | Dietz | B60D 1/36 | 280/477 |
| 2014/0360962 | A1* | 12/2014 | Lv | B61G 7/08 | 213/43 |

* cited by examiner

TELESCOPIC MECHANISM IN TELESCOPIC HITCH BUFFER DEVICE FOR USE IN HIGH SPEED ELECTRIC MULTIPLE UNITS

CROSS-REFERENCE TO RELATED APPLICATIONS

This application is a continuation of International Application No. PCT/CN2012/072228 filed on Mar. 13, 2012, entitled "TELESCOPIC MECHANISM IN TELESCOPIC HITCH BUFFER DEVICE FOR USE IN HIGH SPEED ELECTRIC MULTIPLE UNITS", the content of which is hereby incorporated by reference in its entirety.

FIELD OF THE INVENTION

The invention relates to a railway vehicle hitch buffer device, in particular to a telescopic mechanism in a telescopic hitch buffer device for use in high speed electric multiple unit (EMU) trains, which is installed at the head or tail of an EMU.

BACKGROUND OF THE INVENTION

As one of basic components of a railway vehicle, the coupling buffer has the advantages of rapidly connecting and disconnecting railway vehicles, transmitting vehicle tractive force, and improving vehicle safety and comfortability.

The telescopic hitch buffer device is positioned inside an air guide sleeve of the first carriage of a high-speed EMU to reduce air resistance during running when it does not work, and stretches out of the air guide sleeve for connecting trains if necessary. At present, all telescopic hitch buffer devices used in high-speed EMUs are foreign products, higher in price and longer in delivery period, in particular to supply of spare parts; it is necessary to develop and manufacture telescopic hitch buffer devices in order to solve the current situation that telescopic hitch buffer devices depend on importing from foreign countries and to fill in domestic blanks. Key technologies in manufacturing telescopic hitch buffer devices are extension driving, extension in place and locking, and unlocking functions.

Currently two kinds of telescopic hitch buffer devices in use are as below: one is a manual-operated telescopic hitch buffer device used in an EMU comprising 16 carriages, and the other is a pneumatic-driven automatic telescopic hitch buffer device used in an EMU comprising 8 carriages, both are foreign products. The extension driving of the foreign manual-operated telescopic hitch buffer device adopts an external gear and rack transmission, the unlocking mechanism is also an external one, the buffer system is relatively weak in absorbing impact energy, the overall structure takes up large space, and the extension driving structure is complex.

DISCLOSURE OF THE INVENTION

Technical Problems

SUMMARY OF THE INVENTION

The objective of the invention is to provide a telescopic hitch buffer device for use in high speed electric multiple unit (EMU) trains, which is installed at the head or tail of an EMU, positioned inside the streamline air guide sleeve, and used for connection of EMUs or rescue. The hitch buffer device is retracted and locked if no train requires for reconnection; the air guide sleeve is firstly opened and then the telescopic mechanism is operated to stretch the coupling out if the train requires for reconnection; coupling up is available once the coupling stretches in place and is locked; after disconnection of the train, the telescopic mechanism is operated to retract the coupling, then the coupling is locked, and finally the air guide sleeve is closed. In the above-mentioned process, stretching, locking, retraction and locking functions of the coupling are completed by the telescopic mechanism of the hitch buffer device. In the running process of trains reconnected, the telescopic mechanism bears larger tension load and compression load.

The technical scheme of the invention is as below: a telescopic mechanism in a telescopic hitch buffer device for use in high speed electric multiple unit (EMU) trains, wherein the telescopic mechanism comprises a compression rod located inside a movable housing of said hitch buffer device, one end of said compression rod being connected to the movable housing, and a bearing connector encasing the compression rod; a guiding barrel is fixedly mounted outside the bearing connector; an extension/retraction driving mechanism is provided between the guiding barrel and the movable housing; one end of the compression rod is connected to the movable housing via a torsion spring, keeping the compression rod and the bearing connector in a locked state; a locking mechanism comprises protrusions distributed at the other end of the compression rod, and grooves in engagement with protrusions on the inner wall of the bearing connector; it is in an unlocked state when the protrusions face the grooves, both of which can slide relative to each other; an unlocking driving mechanism is provided on the outside of the movable housing.

Preferentially, the extension/retraction driving mechanism comprising a telescopic tooth gear positioned on the movable housing, and a telescopic gear rack fixed to the guiding barrel. The telescopic tooth gear and the telescopic gear rack were meshed.

Preferentially, the unlocking driving mechanism comprising a steel wire rope fixed to the compression rod and driving the compression rod to rotate.

Preferentially, the protrusions and grooves are distributed equidistantly.

Preferentially, the protrusions are of the same shape.

Preferentially, the grooves are of the same shape.

Preferentially, the bearing connector is provided with two limit stops at the grooves.

The beneficial effects of the invention are as below: since relevant components of the invention are arranged inside the movable housing, volume is reduced, good protection is provided for respective components, and the telescopic mechanism and the locking mechanism are relatively simple in structure, labor-saving, reliable in operation, and can bear relatively large longitudinal loads, besides, the capacity of a buffer system for absorbing impact energy is relatively larger. Upon application of the invention, the telescopic hitch buffer device is available for realization of localization and perfect substitution of imported products.

BEST EMBODIMENTS OF THE INVENTION

Figure 1:
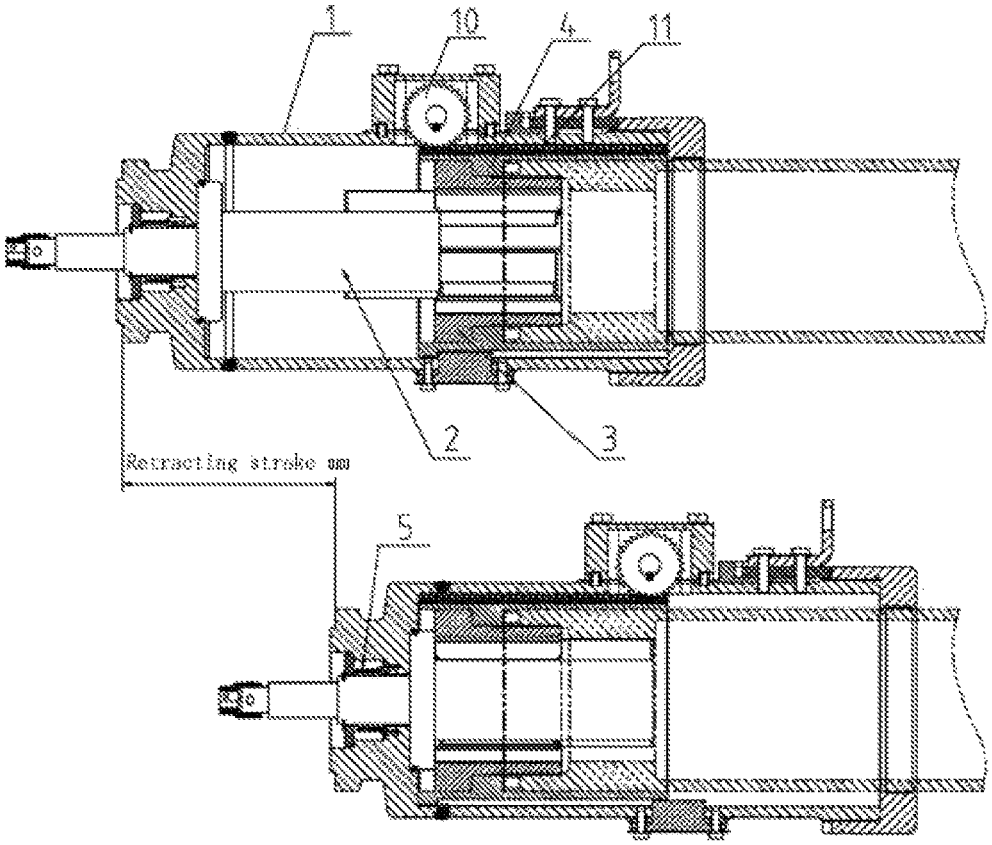
FIG. 1 is a section view of the invention.
Figure 2:
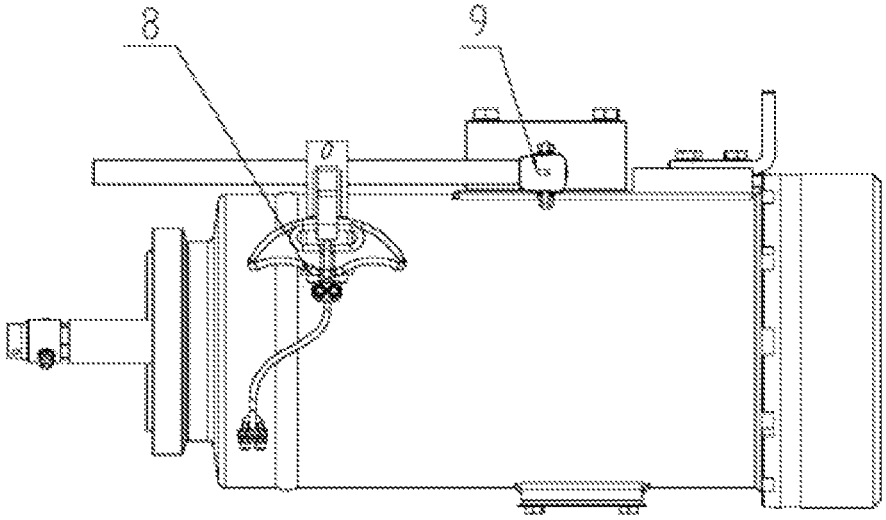
FIG. 2 is an outside view of the invention.
Figure 3:
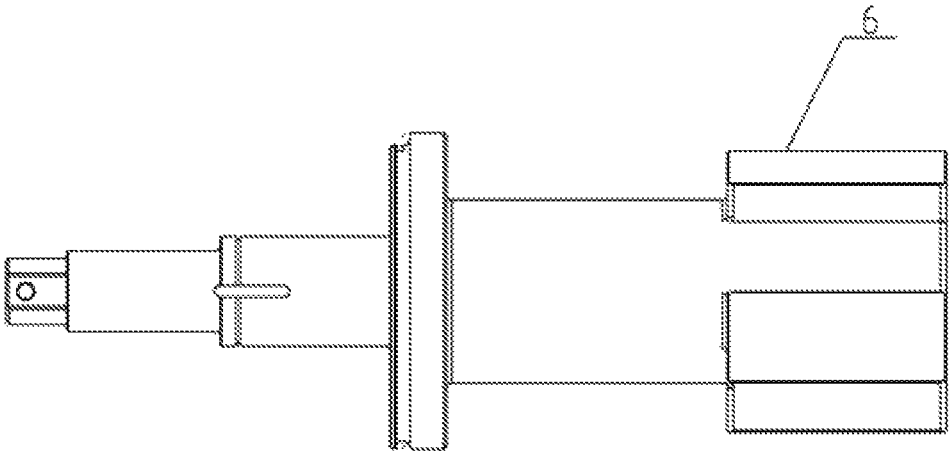
FIG. 3 is a structure diagram of the compression rod in the invention.
Figure 4:
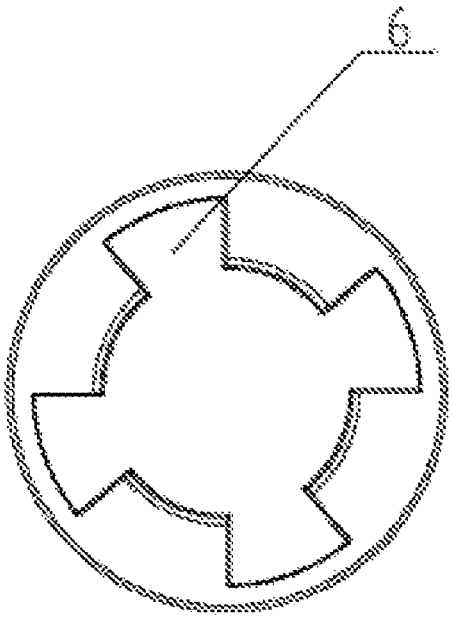
FIG. 4 is a side view of FIG. 3.
Figure 5:
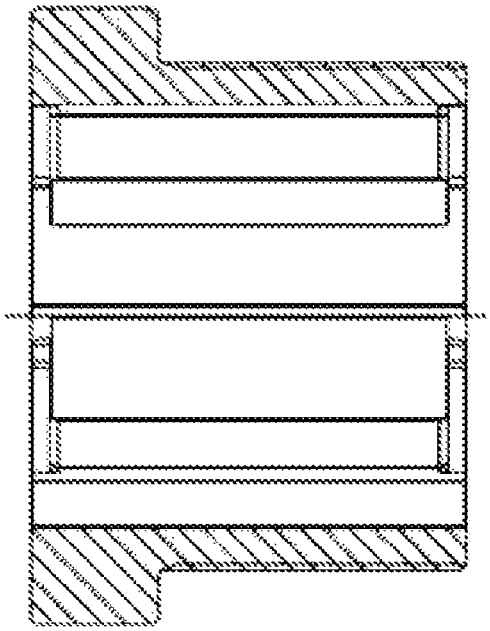
FIG. 5 is a structure diagram of the bearing connector in the invention.
Figure 6:
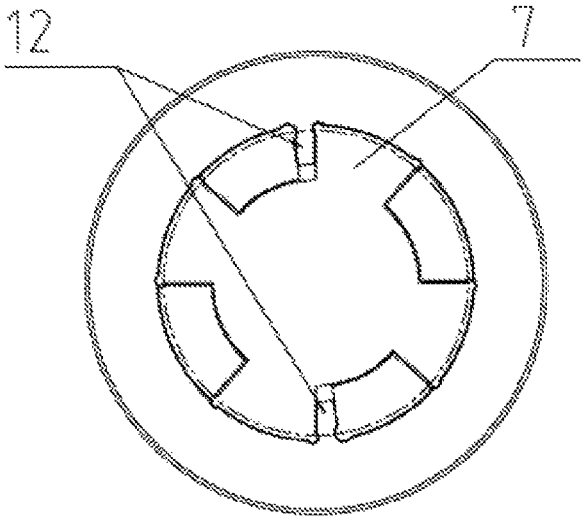
FIG. 6 is a side view of FIG. 5.

Description of embodiments of the invention is made in combination with the accompanying drawings.

Disclosed is a telescopic mechanism in a telescopic hitch buffer device for use in high speed electric multiple unit (EMU) trains. The telescopic mechanism comprises a compression rod 2 located inside a movable housing 1 of said hitch buffer device, one end of said compression rod 2 being connected to the movable housing 1, and a bearing connector 3 encasing the compression rod 2; a guiding barrel 4 is fixedly mounted outside the bearing connector 3; an extension/retraction driving mechanism 9 is provided between the guiding barrel 4 and the movable housing 1, and the extension/retraction driving mechanism comprises a telescopic tooth gear 10 positioned on the movable housing 1 and a telescopic gear rack 11 fixed to the guiding barrel 4; one end of the compression rod 2 is connected to the movable housing 1 via a torsion spring 5, keeping the compression rod 2 and the bearing connector 3 in a locked state; a locking mechanism comprises protrusions 6 distributed at the other end of the compression rod 2, and grooves 7 in engagement with protrusions 6 on the inner wall of the bearing connector 3; the protrusions 6 and grooves 7 are distributed equidistantly, and the protrusions 6 and the grooves 7 are of the same shape. It is in an unlocked state when the protrusions 6 face the grooves 7, both of which can slide relative to each other; an unlocking driving mechanism 8 is provided on the outside of the movable housing 1; the unlocking driving mechanism comprising a steel wire rope fixed to the compression rod 2 and driving the compression rod 2 to rotate. The bearing connector 3 is provided with two limit stops 12 at the grooves 7.

The working process of the invention is as below:

From the retraction state to the stretching state:

The unlocking driving mechanism 8 actuates and drives the compression rod 2 to rotate counterclockwise at a preset angle until the limit stops 12 are unlocked, at this moment, both the compression rod 2 and the bearing connector 3 are in an unlocked state→the extension/retraction driving mechanism 9 starts and drives the compression rod 2 to move ahead until the whole set of extension/retraction driving mechanism stretches out, in this process the action of the unlocking driving mechanism 8 is released→the torsion spring 5 actuates and drives the compression rod 2 to rotate clockwise to the limit stops 12 until the extension/retraction driving mechanism 9 stretches out and is automatically locked, and then the action of the extension/retraction driving mechanism 9 is released, at this moment, both the compression rod 2 and the bearing connector 3 enter into a locked state→the process of stretching is completed.

From the stretching state to the retraction state:

The unlocking driving mechanism 8 actuates and drives the compression rod 2 to rotate counterclockwise at a preset angle until the limit stops 12 are unlocked, at this moment, both the compression rod 2 and the bearing connector 3 are in an unlocked state→the extension/retraction driving mechanism 9 starts and drives the compression rod 2 to move back until the whole set of extension/retraction driving mechanism retracts, in this process the action of the unlocking driving mechanism 8 is released→the torsion spring 5 actuates and drives the compression rod 2 to rotate clockwise to the limit stops 12 until the extension/retraction driving mechanism 9 retracts and is automatically locked, and then the action of the extension/retraction driving mechanism 9 is released, at this moment, both the compression rod 2 and the bearing connector 3 enter into a locked state→the process of retraction is completed.

We claim:

1. A telescopic mechanism in a telescopic hitch buffer device for use in high speed electric multiple unit (EMU) trains, wherein the telescopic mechanism comprises a compression rod (2) located inside a movable housing (1) of said hitch buffer device, one end of said compression rod (2) being connected to the movable housing (1), and a bearing connector (3) encasing the compression rod (2); a guiding barrel (4) is fixedly mounted outside the bearing connector (3); an extension/retraction driving mechanism (9) is provided between the guiding barrel (4) and the movable housing (1); one end of the compression rod (2) is connected to the movable housing (1) via a torsion spring (5), for keeping the compression rod (2) and the bearing connector (3) in a locked state; a locking mechanism comprises protrusions (6) distributed at another end of the compression rod (2), and grooves (7) in engagement with the protrusions (6) on the inner wall of the bearing connector (3); the locking mechanism is in an unlocked state when the protrusions (6) face the grooves (7), both the compression rod (2) and the bearing connector (3) can slide relative to each other; an unlocking driving mechanism (8) is provided on the outside of the movable housing (1).

2. The telescopic mechanism in a telescopic hitch buffer device for use in high speed electric multiple unit (EMU) trains according to claim 1, wherein the telescopic mechanism comprising a telescopic tooth gear (10) positioned on the movable housing (1), and a telescopic gear rack (11) fixed to the guiding barrel (4); wherein the telescopic tooth gear (10) and the telescopic gear rack (11) are meshed.

3. The telescopic mechanism in a telescopic hitch buffer device for use in high speed electric multiple unit (EMU) trains according to claim 2, wherein the bearing connector (3) is provided with two limit stops (12) at the grooves (7).

4. The telescopic mechanism in a telescopic hitch buffer device for use in high speed electric multiple unit (EMU) trains according to claim 1, wherein the unlocking driving mechanism comprises a steel wire rope fixed to the compression rod (2) and driving the compression rod (2) to rotate.

5. The telescopic mechanism in a telescopic hitch buffer device for use in high speed electric multiple unit (EMU) trains according to claim 4, wherein the bearing connector (3) is provided with two limit stops (12) at the grooves (7).

6. The telescopic mechanism in a telescopic hitch buffer device for use in high speed electric multiple unit (EMU) trains according to claim 1, wherein the protrusions (6) and the grooves (7) are distributed equidistantly.

7. The telescopic mechanism in a telescopic hitch buffer device for use in high speed electric multiple unit (EMU) trains according to claim 6, wherein the bearing connector (3) is provided with two limit stops (12) at the grooves (7).

8. The telescopic mechanism in a telescopic hitch buffer device for use in high speed electric multiple unit (EMU) trains according to claim 1, wherein all of the protrusions (6) are of the same shape.

9. The telescopic mechanism in a telescopic hitch buffer device for use in high speed electric multiple unit (EMU) trains according to claim 8, wherein the bearing connector (3) is provided with two limit stops (12) at the grooves (7).

10. The telescopic mechanism in a telescopic hitch buffer device for use in high speed electric multiple unit (EMU) trains according to claim 1, wherein all of the grooves (7) are of the same shape.

11. The telescopic mechanism in a telescopic hitch buffer device for use in high speed electric multiple unit (EMU) trains according to claim 10, wherein the bearing connector (3) is provided with two limit stops (12) at the grooves (7).

12. The telescopic mechanism in a telescopic hitch buffer device for use in high speed electric multiple unit (EMU) trains according to claim 1, wherein the bearing connector (3) is provided with two limit stops (12) at the grooves (7).

* * * * *